US007520262B2

(12) United States Patent
Jeong et al.

(10) Patent No.: US 7,520,262 B2
(45) Date of Patent: Apr. 21, 2009

(54) INTEGRATED TYPE ENGINE BRAKE FOR DIESEL ENGINE

(75) Inventors: Jong Yun Jeong, Iksan-si (KR); Jung Ho Kim, Suwon-si (JP)

(73) Assignee: Hyundai Motor Company, Seoul (KR)

( * ) Notice: Subject to any disclaimer, the term of this patent is extended or adjusted under 35 U.S.C. 154(b) by 4 days.

(21) Appl. No.: 11/635,889

(22) Filed: Dec. 7, 2006

(65) Prior Publication Data

US 2007/0175441 A1 Aug. 2, 2007

(30) Foreign Application Priority Data

Dec. 8, 2005 (KR) ..... 10-2005-0119757

(51) Int. Cl.
*F02D 13/04* (2006.01)

(52) U.S. Cl. ..... 123/321; 123/320

(58) Field of Classification Search ..... 123/321, 123/90.12, 90.13, 90.15, 90.16, 90.17, 320, 123/182.1, 322
See application file for complete search history.

(56) References Cited

U.S. PATENT DOCUMENTS 5,799,631 A * 9/1998 Nakamura ..... 123/90.17
5,803,038 A * 9/1998 Ihara et al. ..... 123/321
5,992,376 A * 11/1999 Okada et al. ..... 123/321
6,394,067 B1 * 5/2002 Usko et al. ..... 123/321
6,439,195 B1 * 8/2002 Warner ..... 123/321
6,810,842 B2 * 11/2004 Itou ..... 123/90.15
RE39,258 E * 9/2006 Cosma et al. ..... 123/321
2003/0101949 A1 * 6/2003 Uchida ..... 123/90.12
2006/0054405 A1 * 3/2006 Custer et al. ..... 184/6

* cited by examiner

*Primary Examiner*—Stephen K Cronin
*Assistant Examiner*—Sizo B Vilakazi
(74) *Attorney, Agent, or Firm*—Morgan, Lewis & Bockius LLP

(57) ABSTRACT

An integrated type engine brake for a diesel engine includes: a cam cap; a valve integral with the cam cap, the valve including an oil inlet and an oil outlet; and a rocker shaft with a brake oil passage in fluid communication with the oil inlet and the oil outlet. The cam cap also has a brake oil passage in fluid communication with the oil inlet and the oil outlet. The brake oil passages of the cam cap and the rocker shaft are in direct fluid communication with one another.

2 Claims, 5 Drawing Sheets

INTEGRATED TYPE ENGINE BRAKE FOR DIESEL ENGINE

CROSS-REFERENCE TO RELATED APPLICATION

This application claims priority to and the benefit of Korean Patent Application No. 10-2005-0119757, filed in the Korean Intellectual Property Office on Dec. 8, 2005, the entire contents of which are incorporated herein by reference.

BACKGROUND OF THE INVENTION

1. Field of the Invention

The present invention relates to an integrated type engine brake for a diesel engine, and more particularly to an integrated type engine brake for a diesel engine, which includes a solenoid valve integrally mounted to a cam cap of the engine, where the cam cap includes an oil passage in communication with an oil inlet and an oil outlet of the solenoid valve to control the engine brake oil.

2. Description of the Related Art

A typical Jake brake system for a diesel vehicle has an operation lever for allowing a driver to operate an engine brake, a solenoid valve for supplying engine oil to an oil passage in an engine brake device, an electronic control unit for controlling the solenoid valve based on electric signals from the operation lever, an oil pressure control valve for controlling the pressure of the engine oil flowing through the solenoid valve, a master piston and a slave piston, which are connected by oil passages to each other, for receiving the engine oil at a desired pressure from the oil pressure control valve, an injector cam for operating an injector for injecting fuel, exhaust valves, and an exhaust cam for operating the exhaust valves. The engine brake system further includes three engine brake housings which are bolted to an upper portion of the engine.

When the driver operates the operation lever, the electronic control unit analyzes conditions to operate the engine brake and transmits an operation signal to the solenoid valve so as to allow the solenoid valve to open the oil passage.

Oil flows through a check valve in the oil pressure control valve and is pumped into the oil passage extending between the master piston and the slave piston, and the master piston moves reciprocally along the profile of the injector cam of the engine.

However, in the above-described engine brake, engine brake oil is supplied through a separate engine brake housing, formed on top of the engine head, and defining oil, resulting in inefficient space usage.

SUMMARY OF THE INVENTION

The present invention provides an integrated type engine brake for a diesel engine. The brake is integrated with parts of the engine, and an engine brake housing is not needed, thereby reducing the weight of the engine brake, increasing a performance of the engine brake, as well as decrease a dimension of an engine cover so as to reduce the product cost.

An integrated type engine brake for a diesel engine includes a cam cap; a valve integral with the cam cap, the valve including an oil inlet and an oil outlet; and a rocker shaft with a brake oil passage in fluid communication with the oil inlet and the oil outlet.

The cam cap also has a brake oil passage in fluid communication with the oil inlet and the oil outlet.

The brake oil passages of the cam cap and the rocker shaft are in direct fluid communication with one another.

BRIEF DESCRIPTION OF THE DRAWINGS

The above and other objects, features, and advantages of the present invention will be more apparent from the following detailed description taken in conjunction with the accompanying drawings, in which.

DETAILED DESCRIPTION OF THE PREFERRED EMBODIMENTS

Figure 1:
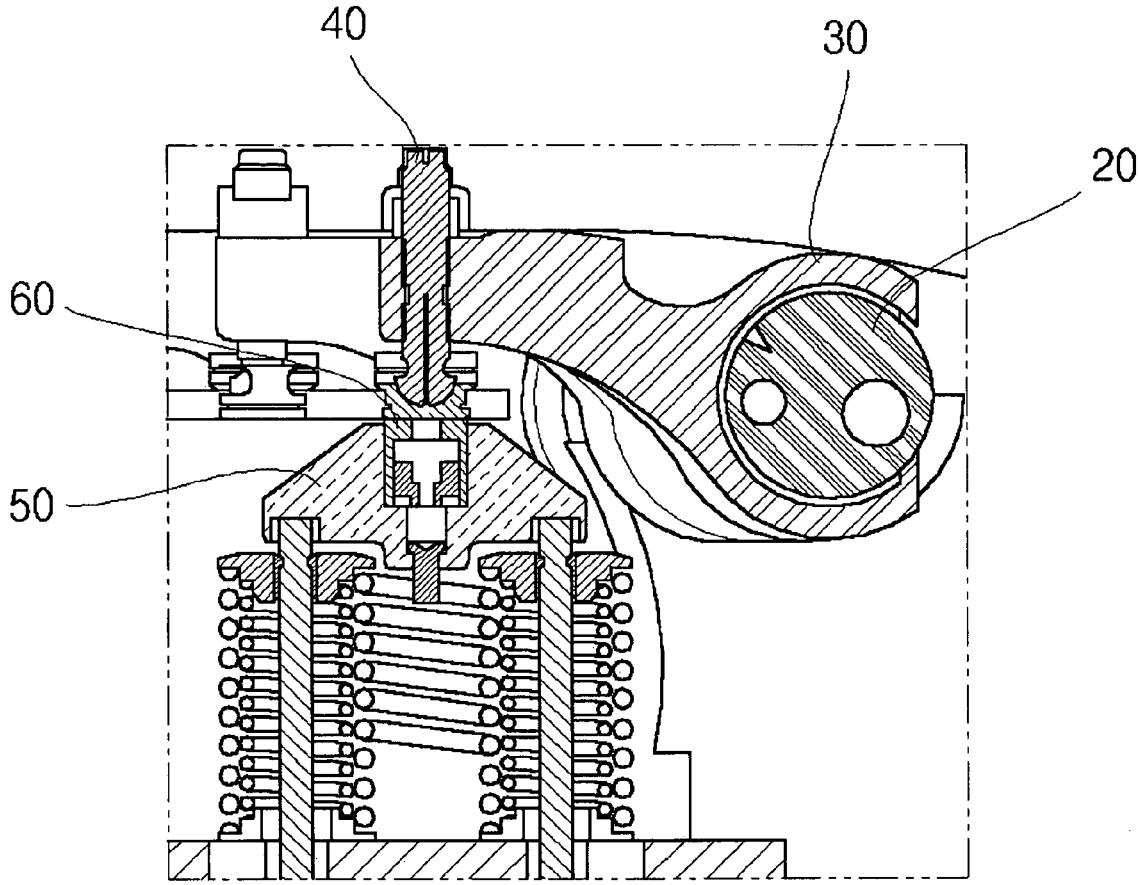
FIG. 1 is a schematic sectional view showing an integrated type engine brake for a diesel engine according to exemplary embodiments of the present invention.

Hereinafter, exemplary embodiments of the present invention will be described with reference to the accompanying drawings.

An integrated type engine brake includes a solenoid valve 10, a cam cap 15, a rocker shaft 20, an exhaust rocker arm 30, an adjustment screw portion 40, a valve bridge 50, and a modulating valve 60.

Figure 2:
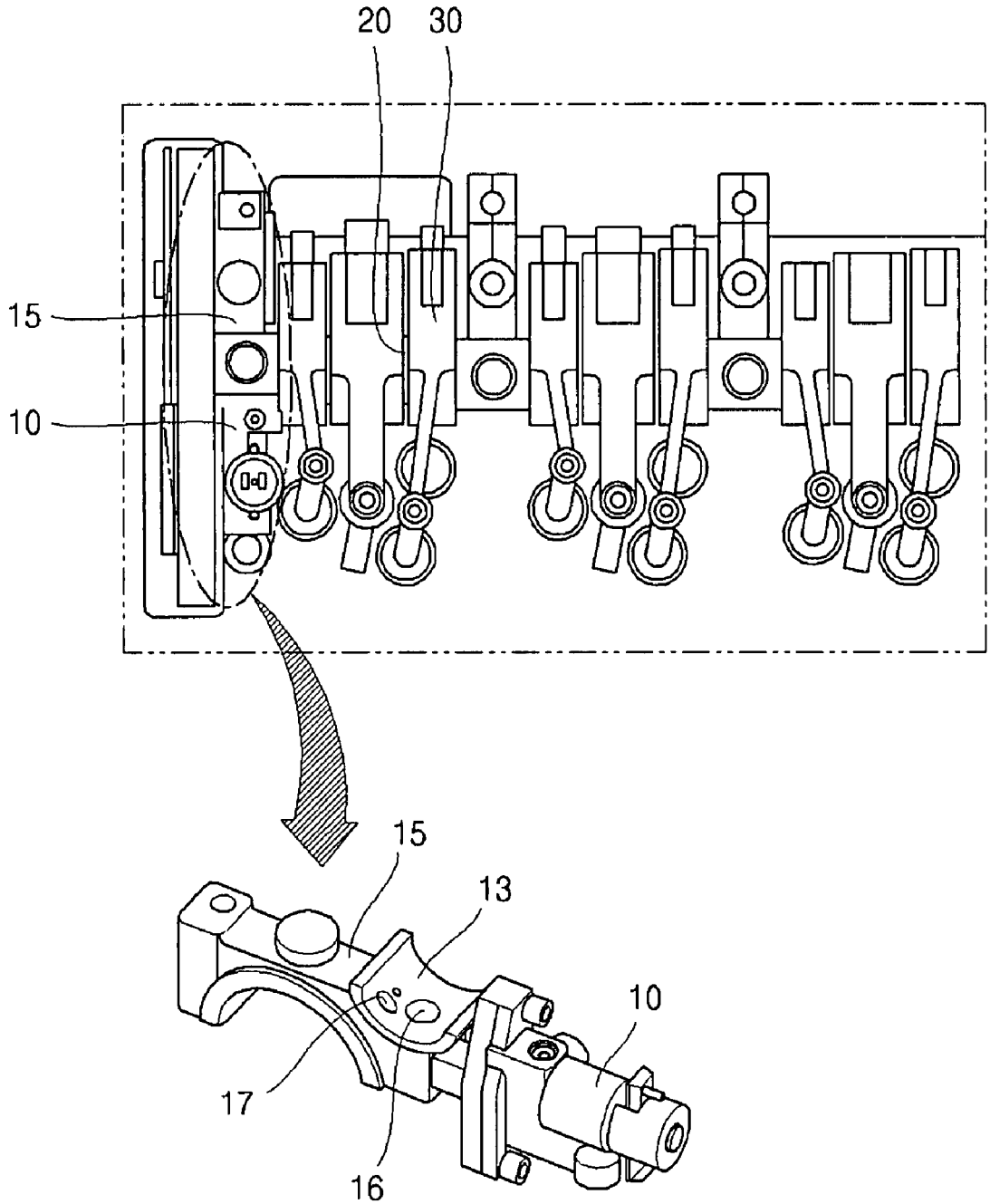
FIG. 2 is a schematic view showing the integrated type engine brake of the diesel engine of FIG. 1, in which a solenoid valve is mounted.

As shown in FIG. 2, the cam cap 15 is integral to the solenoid valve 10, which includes an oil inlet and an outlet 11, 12 for controlling engine brake oil. Therefore, a separate engine brake housing is unnecessary, thereby lightening the engine brake. Furthermore, it is possible to significantly reduce the dimensions of an engine head cover. Further, the cam cap 15 includes a brake oil passage 17 in communication with the oil inlet and the outlet 11, 12 of the solenoid valve 10.

Figure 3A:
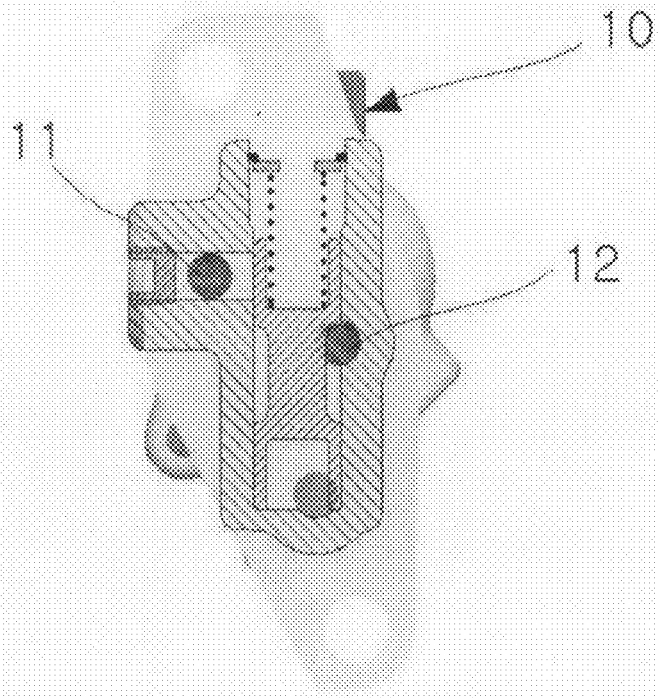
FIGS. 3A and 3B are views illustrating the operation of the solenoid valve according to exemplary embodiments of the present invention.
Figure 3B:
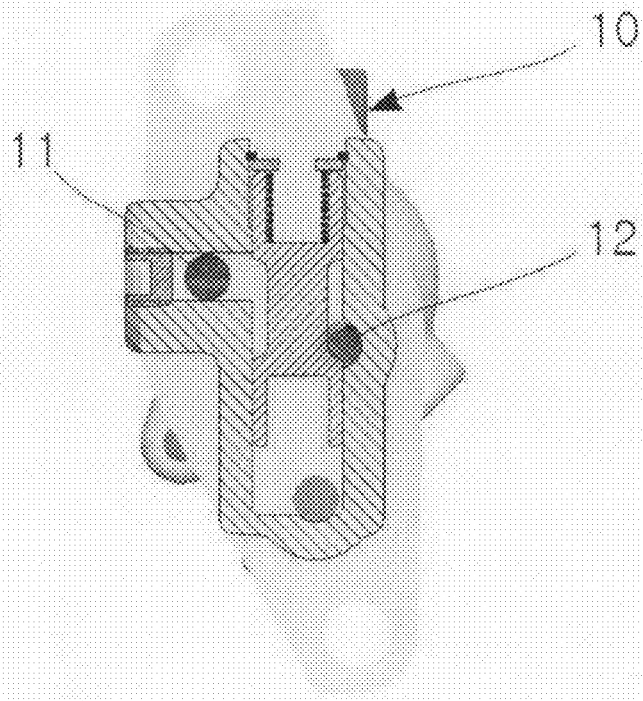

As shown in FIGS. 3A and 3B, the solenoid valve 10 supplies engine brake oil, which is introduced through an oil inlet 11 thereof, to oil passage 25 of the rocker shaft 20 through oil outlet 12 and oil passage 17 when a driver turns on an engine brake switch.

Figure 4:
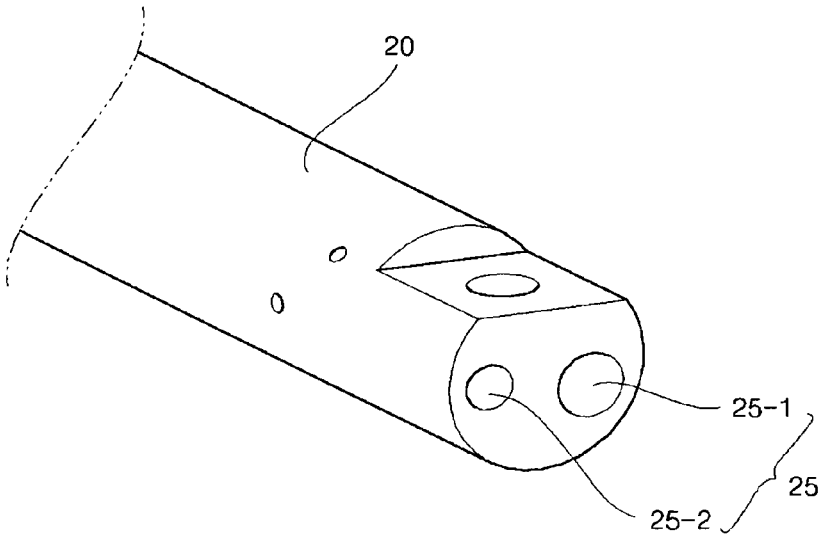
FIG. 4 is a partial perspective view of a rocker shaft mounted on the integrated type engine brake of the diesel engine according to exemplary embodiments of the present invention.
Figure 5:
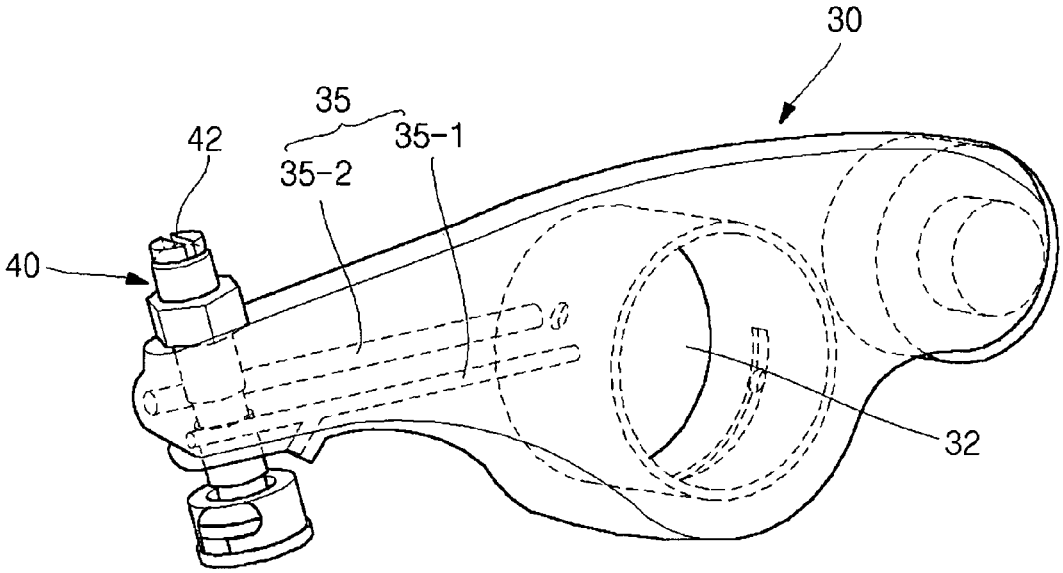
FIG. 5 is a perspective view of an exhaust rocker arm of the integrated engine brake of the diesel engine for the diesel engine according to exemplary embodiments of the present invention, in which an adjustment screw is coupled to the rocker arm.

Referring to FIG. 4, the rocker shaft 20 communicates with the cam cap 15 through the coupling groove 13 in such a manner that the oil passage 25 of the rocker shaft 20 is exactly matched with the oil passages 16,17 of the cam cap 15, i.e. passage 25-1 is connected to passage 16 and passage 25-2 is connected to passage 17. Therefore, when the solenoid valve 10 operates, the engine brake oil flows along the oil passage 25 toward the rocker arm 30.

As shown in FIG. 4, the rocker shaft 20 has two oil passages 25: a first oil passage 25-1 through which engine oil flows, and a second oil passage 25-2 through which the engine brake oil supplied through the solenoid valve 10 flows:

Therefore, the engine brake oil supplied through the solenoid valve 10 flows through the second oil passage 25-2, which is exclusively used as an engine brake oil passage, and in turn is supplied to a fourth oil passage 35-2 in the rocker arm 30, which is exclusively used as an engine brake oil passage.

Figure 6:
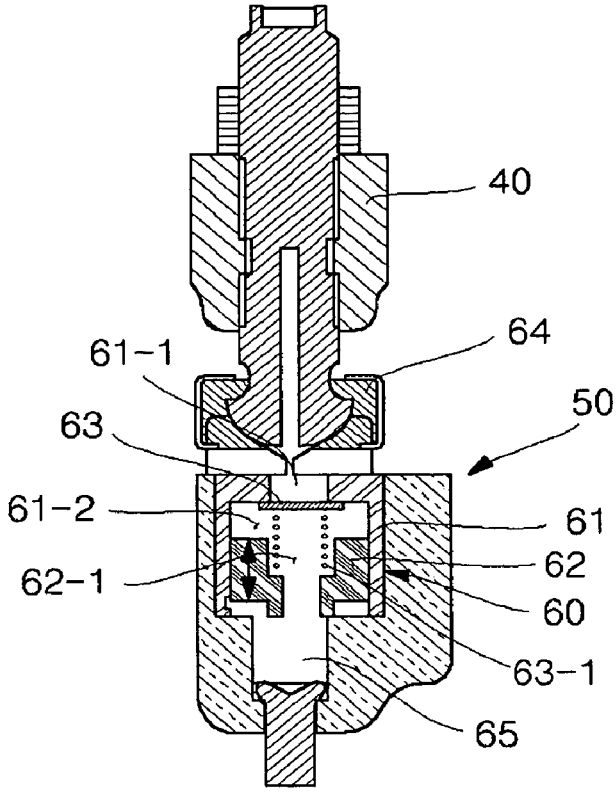
FIG. 6 is a sectional view of a valve bridge of the integrated type engine brake for the diesel engine according to exemplary embodiments of the present invention, in which the valve bridge contains a modulating valve.

Referring to FIG. 6, the exhaust rocker arm 30 is coupled with the rocker shaft 20 in such a manner that the rocker shaft 20 extends through a coupling hole 32 formed in the exhaust rocker arm 30. An oil passage 35 in the exhaust rocker arm 30 matches the oil passage 25 of the rocker shaft 20. Preferably, the rocker shaft 20 is air-tightly coupled to the exhaust rocker arm 30 in order to prevent the engine brake oil from leaking.

The oil passage 35 of the exhaust rocker arm 30 includes a third oil passage 35-1 through which engine oil flows, and a fourth oil passage 35-2 through which engine brake oil flows.

Thus, the engine brake oil flowing along the second oil passage 25-2 of the rocker shaft 20 is supplied to the adjustment screw portion 40 through the fourth oil passage 35-2.

The adjustment screw portion 40 is mounted on one end of the exhaust rocker arm 30 and guides the engine brake oil to a modulating valve 60, described below, received in a valve bridge 50.

Thus, the engine brake oil is supplied through the oil passage of the adjustment screw portion 40 from the rocker arm 30 to the modulating valve 60 in the valve bridge 50 located below the modulating valve 60, of which the volume can be adjusted by rotating a screw 42 clockwise or counterclockwise.

The valve bridge 50 is provided at an upper portion thereof with a joining member 52 made from an elastic material such as rubber and coupled to a lower portion of the valve adjustment screw portion 40. The valve bridge 50 is in close contact to the valve adjustment screw portion 40 so as to prevent the oil from flowing backward and leaking out of the valve bridge 50.

The modulating valve 60 is mounted in the valve bridge 50 and moved upward and downward by inlet engine brake oil passing through the adjustment screw 40 and outlet engine brake oil passing trough an exhaust port 65.

As shown in FIG. 6, the modulating valve 60 includes a slave piston cup 61, a slave piston 62, an opening plate 63, an elephant's foot 64, and an exhaust port 65.

The slave piston cup 61 has a through-hole 61-1 at an upper wall thereof through which the oil flows, and an oil reservoir 61-2 in which the oil is temporally stored. The slave piston cup 61 moves upward and downward as the engine brake oil is introduced in and discharged from the piston cup 61.

When the oil is introduced through the adjustment screw 40 into the piston cup 61, the slave piston cup 61 is moved upward by the oil so as to come into close contact with the elephant's foot 64, thereby preventing the existence of an air gap and increasing oil pressure. When the oil is discharged from and not supplied to the slave piston cup 61, the slave piston cup 61 is moved upward so that an air gap is formed between the piston cup 61 and the elephant's foot 64, thereby releasing the oil pressure.

The slave piston 62 has an oil passage 62-1 through which the engine brake oil flows, which is mounted and moved upward and downward in the slave piston cup 61.

When the remaining oil is discharged through the exhaust port 65 from the slave piston cup 61, the slave piston 62 is moved upward.

The opening plate 63 is supported by a spring 63-1 against the slave piston 62.

When the oil is not introduced into the oil reservoir 61-2 of the slave piston cup 61, the opening plate 63 is in close contact with the upper wall of the slave piston cup 61. When the oil is inlet into the slave piston cup 61, the opening plate 63 is pushed to a top end of the slave piston 62 and comes into close contact with the slave piston 62, so as to cause increment of oil pressure in the oil reservoir 61-2.

The elephant's foot 64 is disposed between the adjustment screw portion 40 and the slave piston cup 61 so as to guide oil flow.

When the oil is not supplied to the oil reservoir 61-2 of the slave piston cup 61, a constant gap is formed between the upper wall of the slave piston cup 61 and a lower surface of the elephant's foot 64. However, when the oil is supplied to the oil reservoir 61-2, the oil pressure causes the slave piston cup 61 to move upward and come into contact with the elephant's foot, thereby removing the gap.

The exhaust port 65 discharges the oil.

When the operation of the engine brake stops, the engine oil is not supplied to the modulating valve 60, so that the opening plate 63 remains in the state of being in close contact with the upper wall of the slave piston cup 61. Further, the oil is discharged through the exhaust port 65. The slave piston 62 moves downward to create a gap between the upper wall of the slave piston cup 61 and the lower surface of the elephant's foot 64.

Here, even though the engine piston reaches the top dead center during the compression stroke, the exhaust rocker arm 20 does not operate, so that it is impossible to move the valve bridge 50. Meanwhile, as soon as the engine piston reaches the top dead center during an exhaust stroke, the exhaust rocker arm 20 operates to cause the adjustment screw portion to push the valve bridge 50 downward, thereby opening exhaust valves and discharging combustion gas.

On the other hand, when the engine brake operates, as the engine brake oil flows through the adjustment valve 40 and urges the opening plate 63 to the upper end of the slave piston 62 so that the opening plate 63 closes the upper end of the slave piston 62, the oil pressure increases in the oil reservoir 61-2.

The increasing oil pressure causes the slave piston cup 61 to move upward and come in close contact with the elephant's foot 64. Simultaneously, the engine brake oil is continuously introduced into the oil reservoir and increases the pressure in the oil reservoir 61-2.

The increasing oil pressure pushes the slave piston cup 61 upward and causes the slave piston cup 61 to be in close contact with the elephant's foot 64 so as to be air-tight.

Thus, when the engine piston reaches the top dead center during the compression stroke of the diesel engine, the oil pressure in the modulating valve 60 causes the valve bridge 50 to move downward, thereby opening the exhaust valves. The exhaust valves of the engine remain open until supply of the engine brake oil to the modulating valve 60 is stopped.

Figure 7:
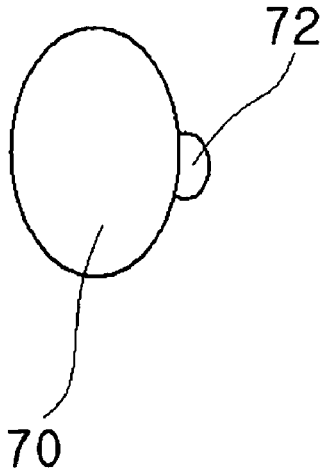
FIG. 7 is a sectional view of an exhaust cam of the integrated type engine brake for the diesel engine according to exemplary embodiments of the present invention.

Meanwhile, the exhaust cam 70, which operates the exhaust rocker arm to open the exhaust valves, has a protuberance 72, as shown in FIG. 7. The time at which the piston of the engine reaches the top dead center is identical with the time at which the protuberance 72 of the cam operates the exhaust rocker arm so as to open the exhaust valves. As a result, it is possible to control optimal opening or open timing of the exhaust valve of the engine.

When the driver turns on an operation switch for the engine brake, the engine brake oil is supplied through the second oil passage 25-2, from the solenoid valve 10 to the fourth oil passage 35-2 of the exhaust rocker arm 30.

Next, the engine brake oil flows to the adjustment screw 40 through the fourth oil passage 35-2 of the exhaust rocker arm 30.

Then, the engine brake oil flows through the oil passage of the adjustment screw 40 to the modulating valve 60 in the valve bridge 50.

The engine brake oil supplied to the modulating valve 60 urges the opening plate 63 to the upper end of the slave piston 62 and causes the opening plate to close the upper end of the slave piston 62, thereby increasing the oil pressure in the oil reservoir 61-2 defined by the slave piston cup 61 and the slave piston 62 of which the upper end is closed by the opening plate 63.

The oil pressure in the oil reservoir 61-2 pushes the piston cup 61 upward so as to make the piston cup 61 come in close contact with the elephant's foot 64, while simultaneously pushing the valve bridge 50 downward so as to open the exhaust valves.

Therefore, even though the engine piston reaches the top dead center during the compression stroke of the engine, combustion does occur in the engine so that the total output of the engine is lowered. Thus, the engine brakes by the engine brake.

As described above, in the integrated type engine brake for the diesel engine according to the present invention, since the engine brake is integrally assembled with the engine parts, for example valve bridge, exhaust rocker arm, and rocker shaft, a separate engine brake housing is unnecessary. Further, it is possible to lighten the product, to increase engine performance, as well as to reduce the volume of the engine head cover, resulting in the reduced cost of manufacturing the engine brake.

While a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An integrated engine brake for a diesel engine, comprising:

a cam cap comprising a first oil outlet and a second oil outlet;

a control valve integral with the cam cap and comprising a brake oil inlet and a brake oil outlet ,wherein the brake oil outlet fluidly communicates with the second oil outlet of the cam cap; and a rocker shaft comprising a first oil passage and a second oil passage wherein the second oil passage is in fluid communication with the second oil outlet of the cam cap, and the first oil passage is in fluid communication with the first oil outlet of the camp cap;

wherein engine brake oil is supplied to the brake oil inlet of the control valve and engine oil is supplied to the first oil outlet of the cam cap.

2. The brake of claim 1, wherein the second oil passage of the rocker shaft is in direct fluid communication with an engine brake oil passage of an exhaust locker arm, wherein the exhaust rocker arm includes an adjustment screw and an engine oil passage being in direct fluid communication with the first oil passage of the rocker shaft.

* * * * *